US009279647B2

(12) United States Patent
Marshall, Jr.

(10) Patent No.: US 9,279,647 B2
(45) Date of Patent: Mar. 8, 2016

(54) UNIVERSAL LIGHTED NOCK AND PROCESSES THEREFOR

(71) Applicant: John F. Marshall, Jr., Destin, FL (US)

(72) Inventor: John F. Marshall, Jr., Destin, FL (US)

( * ) Notice: Subject to any disclaimer, the term of this patent is extended or adjusted under 35 U.S.C. 154(b) by 0 days.

(21) Appl. No.: 14/090,218

(22) Filed: Nov. 26, 2013

(65) Prior Publication Data

US 2014/0148282 A1 May 29, 2014

Related U.S. Application Data

(60) Provisional application No. 61/729,901, filed on Nov. 26, 2012, provisional application No. 61/749,050, filed on Jan. 4, 2013, provisional application No. 61/749,262, filed on Jan. 5, 2013.

(51) Int. Cl.

| | |
|---|---|
| ***F42B 6/06*** | (2006.01) |
| ***F42B 12/36*** | (2006.01) |
| ***F42B 12/38*** | (2006.01) |

(52) U.S. Cl.

CPC ..... *F42B 6/06* (2013.01); *F42B 12/362* (2013.01); *F42B 12/382* (2013.01)

(58) Field of Classification Search

CPC ..... F42B 6/06

USPC ..... 473/570, 578, 585, 586

See application file for complete search history.

(56) References Cited

U.S. PATENT DOCUMENTS

| | | | | |
|---|---|---|---|---|
| 2,525,332 | A | 10/1950 | Alger et al. | |
| 3,749,403 | A | 7/1973 | Austin et al. | |
| 4,340,930 | A | 7/1982 | Carissimi | |
| 4,547,837 | A * | 10/1985 | Bennett | 362/186 |
| 4,615,552 | A | 10/1986 | Bengston | |
| 5,134,552 | A * | 7/1992 | Call et al. | 362/203 |
| 7,021,784 | B2 | 4/2006 | DiCarlo | |
| 7,229,371 | B2 | 6/2007 | Walsh | |
| 7,758,457 | B2 | 7/2010 | Marshall | |
| 7,837,580 | B2 * | 11/2010 | Huang et al. | 473/570 |
| 7,892,119 | B2 | 2/2011 | Marshall | |
| 7,922,609 | B1 | 4/2011 | Hajari | |
| 7,931,550 | B2 * | 4/2011 | Lynch | 473/578 |
| D641,827 | S | 7/2011 | Errett | |
| 7,993,224 | B2 * | 8/2011 | Brywig | 473/586 |
| 8,267,816 | B1 | 9/2012 | Hajari | |
| 8,382,616 | B2 | 2/2013 | Marshall | |
| 2012/0100942 | A1 | 4/2012 | Minica | |

* cited by examiner

*Primary Examiner* — John Ricci

(74) *Attorney, Agent, or Firm* — The Webb Law Firm

(57) ABSTRACT

A lighted nock assembly is disclosed for use with an archery projectile. A cap fits within the tail end of the projectile shaft. The cap comprises a shoulder to bear against the projectile shaft, a recess terminating in a floor portion, and a face to bear against the shoulder of a nock. An LED/battery assembly fits within the recess of the cap abutting the floor portion. A nock fits over the LED/battery assembly and into the recess of the cap. Ready-to-fire, the LED/battery assembly comprises an activation gap between the LED lamp and the body of the battery assembly. A gap, greater than or equal to the activation gap, is left between the shoulder of the nock and the face of the cap. When fired, the bow string drives an internal surface of the nock into the front end of the LED/battery assembly and illuminates the LED lamp.

27 Claims, 3 Drawing Sheets

UNIVERSAL LIGHTED NOCK AND PROCESSES THEREFOR

CROSS-REFERENCE TO RELATED APPLICATIONS

The present United States non-provisional patent application claims priority to, and full benefit of, each of the following: U.S. provisional patent application Ser. No. 61/729,901, filed Nov. 26, 2012, and entitled, "Universal Lighted Nock And Processes Therefor;" U.S. provisional patent application Ser. No. 61/749,050, filed Jan. 4, 2013, and entitled, "Vane For Bolts, Arrows, And The Like;" and U.S. provisional patent application Ser. No. 61/749,262, filed Jan. 5, 2013, and entitled, "Lighted Nock Activation Means And Processes Therefor;" the disclosures of each being incorporated by reference herein.

TECHNICAL FIELD

The present invention relates, generally, to nocks for use with arrows, cross-bow bolts, and the like; and, more particularly, to lighted nocks for use therewith.

BACKGROUND

In archery, it is well-known that a nock is associated with the rearmost portion of an arrow, cross-bow bolt, and the like. A bowstring fits into the nock and propels the arrow from the bow upon release. With the advent of translucent plastic nocks, along with the advent of small-profile light emitting diode ("LED") and battery assemblies, it was recognized that the tail portion of an arrow could be lighted by fitting an LED/battery assembly within the translucent nock. It was recognized, advantageously, that such a lighted nock could provide a means to track arrow flight and targeting, such as may be useful at night, in low light conditions, or in poor visibility situations.

U.S. Pat. No. 4,340,930, issued by Jul. 20, 1982 to Carissimi, and United States Patent Application Publication US 2012/0100942 by Minica, published Apr. 26, 2012, provide examples of such products. Disadvantageously, such products typically are formed in integral units, wherein a user cannot substitute a nock or an LED/battery assembly of his own choosing. Rather, a user is captive to a particular manufacturer's device construction, nock and LED color selections, and product availability. Additionally, due to the sealed and/or closed nature of such devices, switching off the LED/battery assembly after activation can sometimes be difficult and can tax one's dexterity—especially in field-use conditions.

It would be preferable to provide a user with a lighted nock configuration that provides a more universal construction, whereby a user conveniently may gain access to the working components, whereby those components may be transferred to other arrows, whereby the user may substitute nocks and LED/battery assemblies of his choice, and whereby the user can more easily access the LED/battery assembly to activate and deactivate the assembly without undue difficulty—all in field-use conditions.

It is to the disclosure of such devices and related processes of use that the following is directed.

SUMMARY

In general, the present disclosure is directed to lighted nocks for use with arrows, cross-bow bolts, and the like.

Specifically, and pursuant to a preferred embodiment of the present disclosure, a cap is provided that fits within the tail end of a standard tubular arrow shaft. At its front end, the cap comprises a shoulder to bear against the tail end of the tubular arrow shaft, and a face to bear against the shoulder of a nock.

The cap further comprises a recess therewithin, terminating in a floor portion at its tail end. An LED/battery assembly fits within the recess of the cap, the tail end of the LED/battery assembly abutting the floor portion of the cap. The tail end of a nock fits over the LED/battery assembly and into the recess of the cap.

In ready-to-fire position, the LED/battery assembly is in deactivated position, comprising an activation gap between the LED lamp and the body of the battery assembly. A corresponding gap, greater than or equal to the activation gap, is left between the shoulder of the nock and the face of the cap.

When fired, the bow string drives an internal surface of the nock into the front end of the LED/battery assembly. Because the tail end of the LED/battery assembly is in contact with the floor portion of the cap, the driving force of the nock acts to close the activation gap; thereby, illuminating the LED lamp.

To reset the assembly for firing anew, one simply removes the nock and resets the LED/battery assembly to its deactivated position, which is done by pulling the LED lamp to reopen the activation gap. One then places the LED/battery assembly and nock into their ready-to-fire position within the cap, leaving a gap as described above.

Accordingly, and advantageously, the subject matter of the present disclosure provides a user with a lighted nock configuration that provides a more universal construction than has heretofore been developed in the known prior art, whereby a user conveniently may gain access to the working components, whereby those components may be transferred to other arrows, whereby the user may substitute nocks and LED/battery assemblies of his choice, and whereby the user can more easily access the LED/battery assembly to activate and deactivate the assembly without undue difficulty—all in field-use conditions.

These and other features and advantages of the various embodiments of devices and related systems comprising, as set forth within the present disclosure, will become more apparent to those of ordinary skill in the art after reading the following Detailed Description of Illustrative Embodiments and the Claims in light of the accompanying drawing Figures.

BRIEF DESCRIPTION OF THE DRAWINGS

Accordingly, the within disclosure will be best understood through consideration of, and with reference to, the following drawing Figures, viewed in conjunction with the Detailed Description of Illustrative Embodiments referring thereto, in which like reference numbers throughout the various Figures designate like structure, and in which.

Figure 1:
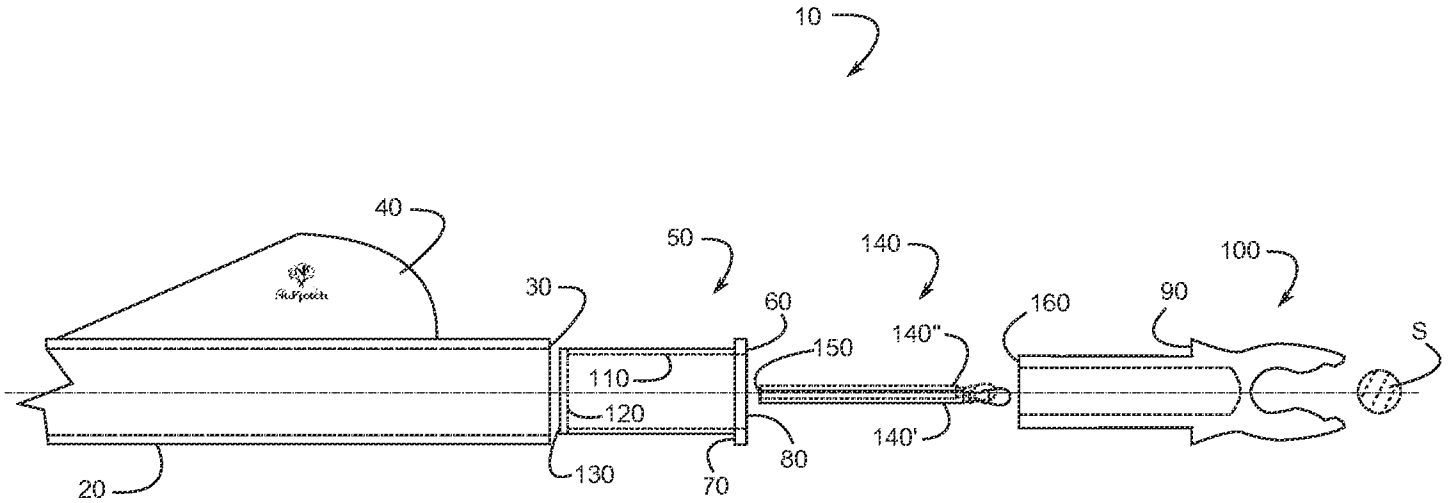
FIG. 1 is an exploded view of the subject matter of the present disclosure.

It is to be noted that the drawings presented are intended solely for the purpose of illustration and that they are, therefore, neither desired nor intended to limit the invention to any or all of the exact details of construction shown, except insofar as they may be deemed essential to the claimed invention.

DETAILED DESCRIPTION OF ILLUSTRATIVE EMBODIMENTS

In describing the several embodiments illustrated in the Figures, specific terminology is employed for the sake of clarity. The invention, however, is not intended to be limited to the specific terminology so selected, and it is to be understood that each specific element includes all technical equivalents that operate in a similar manner to accomplish a similar purpose. Additionally, in the Figures, like reference numerals shall be used to designate corresponding parts throughout the several Figures.

Figure 2:
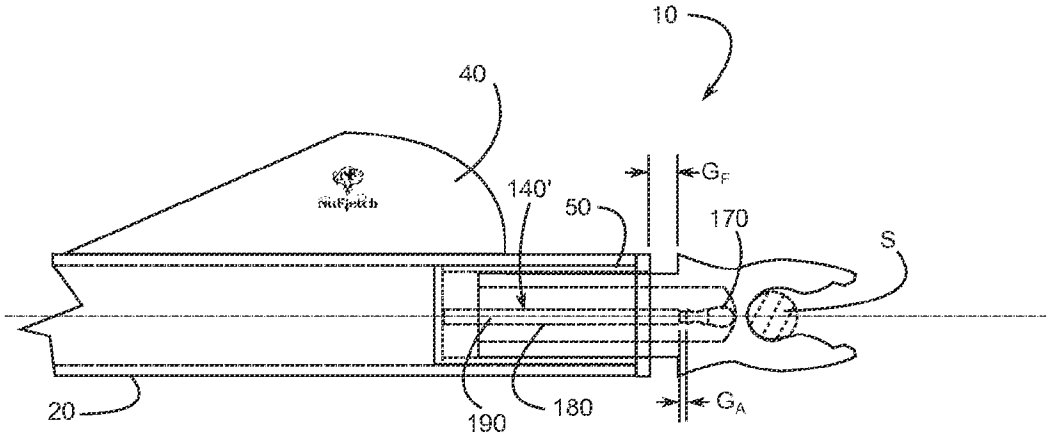
FIG. 2 illustrates the device of FIG. 1 in assembled, ready-to-fire position.
Figure 3:
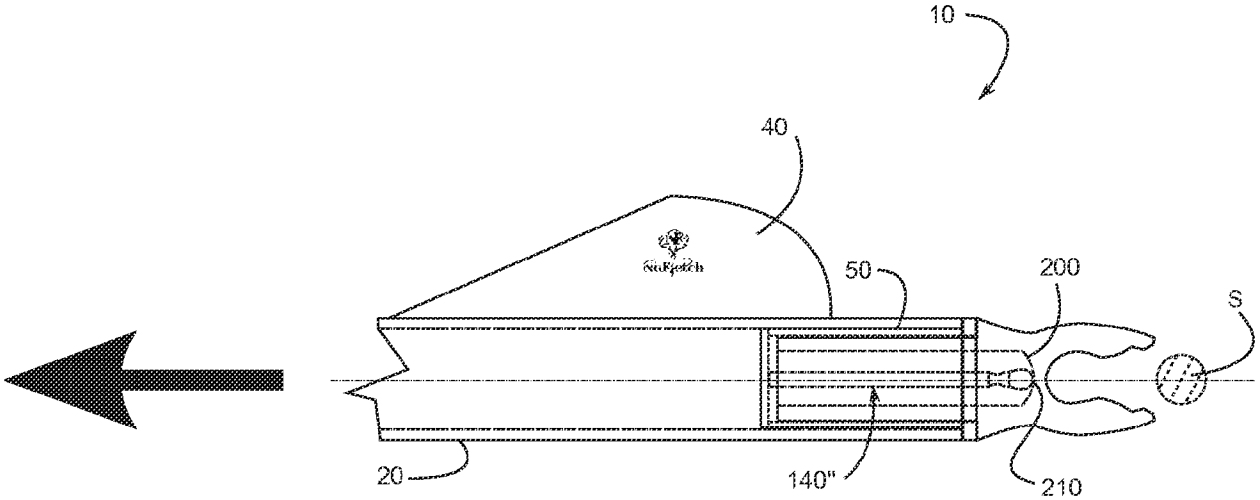
FIG. 3 illustrates the device of FIG. 2 in assembled, just-fired position.

Illustrated in FIGS. 1-3 is a preferred embodiment of lighted nock 10 for use with arrows, cross-bow bolts, and the like, according to the subject matter of the present disclosure. With reference to FIG. 1, conventional, tubular arrow shaft 20 comprises tail end 30. To arrow shaft 20 is typically attached three fletch members 40, the fletch members used to stabilize the arrow during flight.

In order to prepare an arrow to receive lighted nock 10 of the present disclosure, one removes any prefitted nock from tail end 30. In lieu thereof, cap 50 fits within tail end 30 of tubular arrow shaft 20. At its front end 60, cap 50 comprises shoulder 70 to bear against tail end 30 of tubular arrow shaft 20, and face 80 to bear against shoulder 90 of nock 100. In some embodiments, cap 50 is constructed of aluminum; however, any material may be used that would be suitable to the intended applications and uses described herein. It is noted that, for a secure fit, a user optionally may bond cap 50 into tail end 30 of tubular arrow shaft 20 by use of any suitable adhesive.

Cap 50 further comprises recess 110 therewithin, terminating in floor portion 120 at tail end 130. LED/battery assembly 140 (shown in FIG. 1 both in an open, deactivated configuration 140' and a closed, activated configuration 140") fits within recess 110 of cap 50, tail end 150 of LED/battery assembly 140 abutting floor portion 120 of cap 50. In most circumstances, it is preferred that LED/battery assembly initially be in open, deactivated configuration 140', so that the user's night vision is not interrupted by the brightly illuminated LED lamp 170, and so that a user's field position remains concealed prior to firing.

In ready-to-fire position, best seen with reference to FIG. 2, tail end 160 of nock 100 fits over LED/battery assembly 140 and into recess 110 of cap 50. As described above, LED/battery assembly 140 preferably remains in deactivated position 140', comprising activation gap $G_A$ between the LED lamp 170 and body 180 of battery assembly 190. A corresponding firing gap $G_F$, greater than or equal to activation gap $G_A$, is left between shoulder 90 of nock 100 and face 80 of cap 50.

Best seen with reference to FIG. 3, when the arrow, so configured, is fired, bow string S drives internal surface 200 of nock 100 into front end 210 of LED/battery assembly 140. Because tail end 150 of LED/battery assembly 140 is in contact with floor portion 120 of cap 50, the driving force of nock 100 acts to compress the LED/battery assembly 140 against the floor portion 120 of the cap recess 110 to close firing gap $G_F$, and, in turn, activation gap $G_A$; thereby, illuminating LED lamp 170.

To reset lighted nock 10 for firing anew, one simply removes nock 100 and resets LED/battery assembly 140, which is removably disposed within the recess of the nock (100), to its deactivated position 140', which is done by pulling the LED lamp to reopen activation gap $G_A$. One then places LED/battery assembly 140 and nock 100 into their ready-to-fire position within cap 50, leaving firing gap $G_F$ as described above.

It is noted that, in some embodiments, LED/battery assembly 140 may comprise an LED with built-in, pin type lithium battery, such as the JNJ R-type assembly (JNJ Co., LTd., Korea). Suitably configured; however, lighted nock 10 may be used in association with any of a variety of LED/battery assemblies currently on the market.

Figure 4:
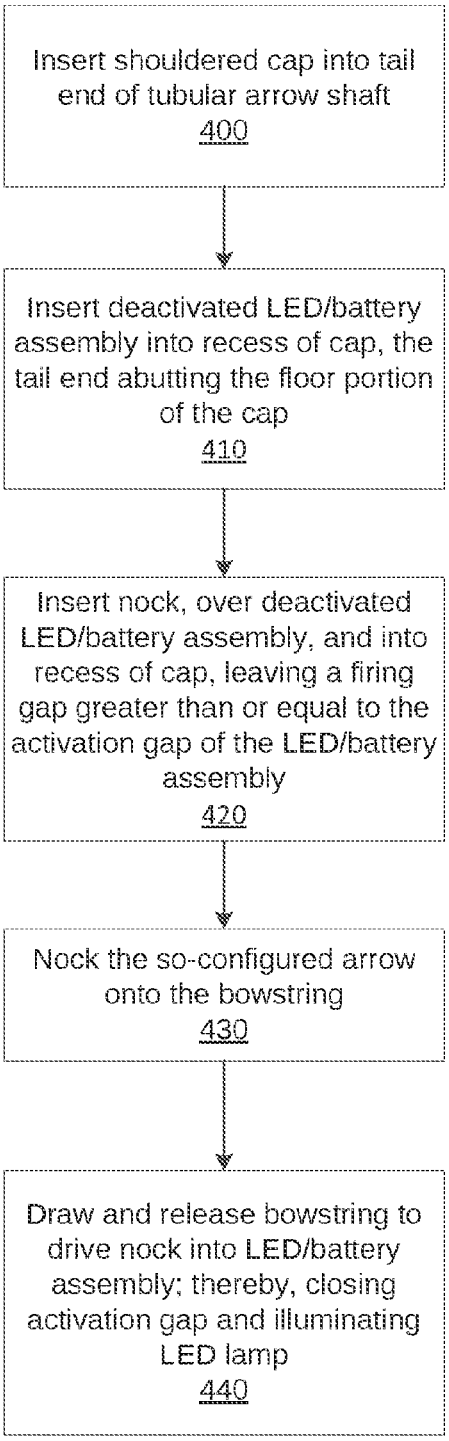
FIG. 4 is a flowchart illustrating a process for using a lighted nock according to the subject matter of the present disclosure.

Turning now to FIG. 4, the above-described steps for configuring and firing an arrow carrying a lighted nock in accordance with the present disclosure are outlined in process flowchart form. At step 400, one inserts a shouldered cap, such as, for example, cap 50, into the tail end of a tubular arrow shaft. At step 410, one inserts a deactivated LED/battery assembly, such as, for example, LED/battery assembly 140, into a recess within the cap. The tail end of the LED/battery assembly should abut a floor portion within the cap.

At step 420, a nock, such as, for example, nock 100, is inserted over the deactivated LED/battery assembly and into the recess of the cap. A firing gap greater than or equal to the activation gap of the LED/battery assembly should be maintained.

At step 430, the arrow, configured as described above, is nocked onto the bowstring. At step 440, the bowstring is drawn and released, driving the nock into the LED/battery assembly; thereby, closing the firing gap and the activation gap, and illuminating the LED lamp.

Figure 5:
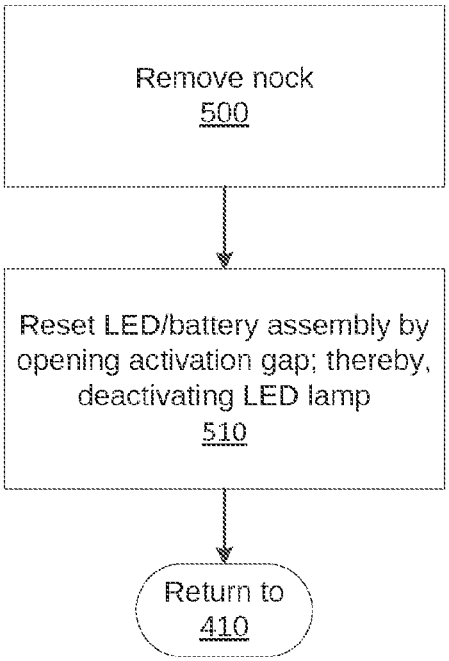
FIG. 5 is a flowchart illustrating a process for resetting and reusing a lighted nock according to the subject matter of the present disclosure.

Referring now to FIG. 5, the above-described steps for resetting and readying for refiring an arrow carrying a lighted nock in accordance with the present disclosure are outlined in process flowchart form. At step 500, the nock is removed. At step 510, the LED/battery assembly is reset to a deactivated condition by opening the activation gap. At this point, one may ready the lighted nock for refiring by returning to the process of FIG. 4, step 410.

Having thus described exemplary embodiments of the subject matter of the present disclosure, it is noted that the within disclosures are exemplary only and that various other alternatives, adaptations, and modifications may be made within the scope and spirit of the present invention. For example, while the disclosure set forth hereinabove has been provided with reference to conventional arrows, the subject matter could be extended to use in association with bolts for use in association with cross-bows, or the like, without limitation.

Furthermore, the subject matter of the present disclosure may be utilized in association with target practice, situational shooting, and/or the like, as well as with hunting and other in-field uses.

In some embodiments, the subject matter of the present disclosure may be provided in packaged form comprising one or more suitably configured nock, LED/battery assembly, and cap. In such form, a user may utilize his own arrow in association with the subject matter of the present disclosure In some embodiments, the subject matter of the present disclosure may be provided in packaged form comprising one or more, optionally pre-fletched, arrow, along with one or more suitably configured nock, LED/battery assembly, and cap.

Accordingly, the present subject matter is not limited to the specific embodiments as illustrated herein, but is only limited by the following claims.

What is claimed:

1. A lighted nock assembly for use with an arrow, for illumination when the arrow is fired with a bow string, the lighted nock assembly comprising:

a cap having a recess with a floor portion, an LED/battery assembly disposed within said recess of said cap; and a nock, wherein at least a portion of said nock is configured to fit in frictional engagement within said recess of said cap; and wherein said LED/battery assembly is activated by driving said nock against said LED/battery assembly thereby compressing said LED/battery assembly against said floor portion of said cap and causing illumination of an LED lamp within said LED/battery assembly.

2. The lighted nock assembly of claim 1 wherein said cap further comprises a shoulder.

3. The lighted nock assembly of claim 2 wherein said cap further comprises a face.

4. The lighted nock assembly of claim 3 wherein said shoulder of said cap is configured to abut a tail end of the arrow.

5. The lighted nock assembly of claim 4 wherein said nock comprises a shoulder configured to abut said face of said cap.

6. The lighted nock assembly of claim 1 wherein said LED/battery assembly may be configured to comprise an activation gap.

7. The lighted nock assembly of claim 6 in a ready-to-fire configuration comprising a firing gap between a shoulder of said nock and a face of said cap, said firing gap being greater than or equal to said activation gap of said LED/battery assembly.

8. The lighted nock assembly of claim 1, wherein the LED and battery assembly is removable disposed within the recess of the nock.

9. A lighted nock assembly for use with an arrow, the lighted nock assembly comprising:

a cap, an LED/battery assembly, and a nock, wherein at least a portion of said nock is configured to fit in frictional engagement within a recess of said cap, and wherein said nock comprises an internal recess terminating in an internal surface, said internal surface for contacting said LED lamp of said LED/battery assembly.

10. The lighted nock assembly of claim 9 wherein said cap further comprises a face and wherein said nock comprises a shoulder configured to abut said face of said cap.

11. The lighted nock assembly of claim 9 wherein said shoulder of said cap is configured to abut a tail end of the arrow.

12. The lighted nock assembly of claim 9 wherein said LED/battery assembly can be configured to comprise an activation gap.

13. The lighted nock assembly of claim 12 in a ready-to-fire configuration comprising a firing gap between a shoulder of said nock and a face of said cap, said firing gap being greater than or equal to said activation gap of said LED/battery assembly.

14. A projectile for archery having an LED/battery assembly that is activated when said projectile is fired with a bow string comprising:

a tubular shaft;

a cap disposed within a tail end of said tubular shaft, wherein said cap has a recess and a floor portion;

said LED/battery assembly disposed within said recess in said cap;

a nock disposed within said recess in said cap, said nock encompassing said LED/battery assembly within a recess formed within said nock; and wherein said LED/battery assembly is activated by driving said nock against said LED/battery assembly thereby compressing said LED/battery assembly against said floor portion of said cap and causing illumination of an LED lamp within said LED/battery assembly.

15. The projectile of claim 14 wherein said cap further comprises a shoulder.

16. The projectile of claim 15 wherein said cap further comprises a face.

17. The projectile of claim 16 wherein said shoulder of said cap is configured to abut a tail end of said tubular shaft.

18. The projectile of claim 16 wherein said nock further comprises a shoulder configured to abut said face of said cap, and an internal surface within said recess of said nock, said internal surface for contacting said LED lamp of said LED/battery assembly.

19. The projectile of claim 14 wherein at least a portion of said nock is configured to fit in frictional engagement within said recess of said cap.

20. The projectile of claim 14 wherein said LED/battery assembly may be configured to comprise an activation gap.

21. The projectile of claim 20 in a ready-to-fire configuration comprising a firing gap between a shoulder of said nock and a face of said cap, the firing gap being greater than or equal to said activation gap of said LED/battery assembly.

22. A process for using a lighted nock assembly in association with an arrow, the process comprising the steps of:

(a.) inserting a shouldered cap into the tail end of a tubular arrow shaft;

(b.) inserting a deactivated LED/battery assembly into a recess within the cap, the tail end of the LED/battery assembly abutting a floor portion of the cap;

(c.) inserting a nock over the LED/battery assembly and into the recess within the cap;

(d.) establishing a firing gap between a shoulder of the nock and a face of the cap, the firing gap being greater than or equal to an activation gap of the LED/battery assembly;

(e.) nocking the arrow onto a bowstring; and (f.) drawing and releasing the bowstring, driving the nock into the LED/battery assembly; thereby, closing the firing gap and the activation gap, and illuminating an LED lamp associated with the LED/battery assembly.

23. A lighted nock assembly for use with an arrow, for illumination when the arrow is fired with a bow string, said lighted nock assembly comprising:

a cap, wherein said cap comprises a recess, a floor, a shoulder, and a face, wherein said shoulder of said cap is configured to abut a tail end of the arrow;

an LED/battery assembly disposed within said recess of said cap, and a nock; and wherein said LED/battery assembly is activated by driving said nock against said LED/battery assembly thereby compressing said LED/battery assembly against said floor portion of said cap and causing illumination of an LED lamp within said LED/battery assembly.

24. A lighted nock assembly for use with an arrow, for illumination when the arrow is fired with a bow string, said lighted nock assembly comprising:

a cap having a recess with a floor portion;

an LED/battery assembly disposed within said recess of said cap, wherein said LED/battery assembly may be configured to comprise an activation gap; and a nock; and wherein said LED/battery assembly is activated by driving said nock against said LED/battery assembly thereby compressing said LED/battery assembly against said floor portion of said cap and causing illumination of an LED lamp within said LED/battery assembly.

25. The lighted nock assembly of claim 24 in a ready-to-fire configuration comprising a firing gap between a shoulder of said nock and a face of said cap, the firing gap being greater than or equal to said activation gap of said LED/battery assembly.

26. A lighted nock assembly for use with an arrow, the lighted nock assembly adapted to operate in an activated state and in a deactivated state comprising:

a cap having a recess with a floor portion;

an LED/battery assembly; and a nock having an internal surface, wherein at least a portion of said nock is configured to fit in frictional engagement within a recess of said cap; and wherein said LED/battery assembly is positioned within said recess between said floor portion and said internal surface of said nock such that, in a deactivated configuration, when said nock is pushed toward said cap, said internal surface of said nock compresses said assembly against said floor portion and said assembly is activated.

27. A method for using a lighted nock assembly in association with an arrow, the process comprising the steps of:

(a.) inserting a cap into the tail end of a tubular arrow shaft;

(b.) inserting a deactivated LED/battery assembly into a recess within the cap;

(c.) inserting a nock over the LED/battery assembly and into the recess within the cap with frictional engagement therebetween;

(d.) establishing a firing gap between a shoulder of the nock and a face of the cap, the firing gap being greater than or equal to an activation gap of the LED/battery assembly;

(e) nocking the arrow onto a bow string; and (f.) drawing and releasing the bow string, driving the nock into the LED/battery assembly, thereby closing the firing gap and the activation gap, and illuminating an LED lamp of the LED/battery assembly.

* * * * *